US006334912B1

(12) United States Patent
Ganin et al.

(10) Patent No.: US 6,334,912 B1
(45) Date of Patent: Jan. 1, 2002

(54) THERMOMECHANICAL METHOD FOR PRODUCING SUPERALLOYS WITH INCREASED STRENGTH AND THERMAL STABILITY

(75) Inventors: Eti Ganin, Milwaukee, WI (US); Gregory Reznikov, Akron, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/224,665

(22) Filed: Dec. 31, 1998

(51) Int. Cl.[7] ..... C22C 30/00; C22F 1/10; C22D 8/00

(52) U.S. Cl. ..... 148/419; 148/442; 148/707; 420/581

(58) Field of Search ..... 148/677, 676, 148/410, 419, 442, 707; 420/584.1, 675, 581

(56) References Cited

U.S. PATENT DOCUMENTS

| | | | | | |
|---|---|---|---|---|---|
| 3,660,177 | A | * | 5/1972 | Brown et al. | 148/677 |
| 4,066,447 | A | * | 1/1978 | Smith, Jr. et al. | 420/447 |
| 4,487,743 | A | | 12/1984 | Smith et al. | 420/459 |
| 4,612,062 | A | | 9/1986 | Nazmy et al. | |
| 5,120,373 | A | | 6/1992 | Miller et al. | |
| 5,360,496 | A | * | 11/1994 | Kulman et al. | 148/410 |
| 5,593,519 | A | | 1/1997 | Blankenship, Jr. et al. | |
| 5,759,305 | A | * | 6/1998 | Benz et al. | 148/676 |

FOREIGN PATENT DOCUMENTS

| | | |
|---|---|---|
| WO | 9413849 | 6/1994 |
| WO | 9600310 | 1/1996 |

OTHER PUBLICATIONS

Holderby, M.A. et al. "Process Sensitivities in Incoloy alloy 909"—Effect and Control, Apr., 1991, pp. 1–20.

Smith, D.F. et al. "A History of Controlled, Low Thermal Expansion Superalloys", (1990) pp 253–272.

(No Author), "Superalloys for Super Performance": Design News: Jun. 21, 1982, pp 40–42.

Inco International's Data Sheet on Incoloy Alloy 909, pp 1–8 (no date).

* cited by examiner

*Primary Examiner*—Deborah Yee
(74) *Attorney, Agent, or Firm*—Pat Winston Kennedy, Esq.; Kilpatrick Stockton LLP

(57) ABSTRACT

A thermomechanical process for producing high strength and thermally stable alloys, comprising the steps of: pre-heating an alloy bar or rod stock of a pre-selected size at a temperature below that at which grain growth occurs; and thereafter rotoforging the heated alloy bar or rod stock at a sufficient deformation level and temperature to fragment the grain boundary phases of the alloy. The resulting alloy is characterized by an ultra-fine, very uniform grain size, high tensile strength at room and high temperatures, good ductility, and a stress-rupture rate that is about twice as long as conventional alloys that have not undergone the thermo-mechanical process.

19 Claims, 11 Drawing Sheets

THERMOMECHANICAL METHOD FOR PRODUCING SUPERALLOYS WITH INCREASED STRENGTH AND THERMAL STABILITY

BACKGROUND OF THE INVENTION

The present invention relates to superalloys having increased strength and thermal stability at room and elevated temperatures. More particularly, the present invention relates to a thermomechanical process involving rotoforging for producing superalloys with superior mechanical and thermal properties.

Superalloys such as nickel-, iron-nickel- and cobalt-based alloys have long been known and used in high temperature applications (at temperatures generally above 540° C. (1000° F.)). Such alloys have been particularly useful in the construction of aircraft engine components because of the operating requirements for strength and the ability to resist loads for long periods of time at elevated temperatures. These alloys are also used in electron beam generating devices, such as x-ray tubes, which also operate in high temperature and high mechanical stress environments.

X-ray tubes are typically comprised of opposed electrodes that are enclosed within a cylindrical vacuum vessel. The electrodes, in turn, comprise a cathode assembly, which emits electrons and is positioned at some distance from the target track of a rotating, disc-shaped anode assembly. The target track or impact zone of the anode is typically constructed from a refractory metal with a high atomic number and melting point, such as tungsten or tungsten alloy. The cathode has a filament which emits thermal electrons. The electrons are then accelerated across the potential voltage difference between the cathode and anode assemblies, impacting the target track of the anode at high velocity. A small fraction of the kinetic energy of the electrons is converted to high energy electromagnetic radiation or x-rays, while the balance is converted to thermal energy or is contained in back scattered electrons. The thermal energy from the hot target is radiated to other components within the vacuum vessel of the x-ray tube, and is ultimately removed from the vessel by a circulating cooling fluid. The back scattered electrons further impact on other components within the vacuum vessel, resulting in additional heating of the x-ray tube. The resulting elevated temperatures generated by the thermal energy subject the x-ray tube components to high thermal stresses which are problematic in the operation of the x-ray tube.

Additionally, because of the very high temperatures at the target plane of the anode, it is important that the alloys located in close proximity to the target plane be fabricated in such a manner to withstand the elevated temperatures and thermal stresses. Alloy that is typically used in x-ray tube components is designated as Alloy 909 and known by trade names Incoloy® 909 (manufactured by Inco International, Huntington, W.Va). and CTX-909 (manufactured by Carpenter Alloys, Reading, Pa). Although their compositions are substantially the same, Incoloy® 909 and CTX-909 exhibit different microstructural characteristics which will be discussed in greater detail below.

Alloy 909 is a controlled, low thermal expansion alloy that is typically used at temperatures not higher than 700° C. (1292° F.). Alloy 909 is manufactured in the form of an ingot using vacuum induction melting (VIM) and vacuum arc remelting (VAR) process. A wrought bar is then made from the ingot by a hot rolling process. Small diameter alloy bars and rods that are used for fastener applications are usually made from a cold drawn wire.

According to Aerospace Material Specification (AMS) Guidelines 5884, the material properties of Incoloy® 909 are quite sensitive to the thermomechanical treatment received during processing of the alloy. AMS 5884 specifies grain size requirements for alloys such as Incoloy® 909 in industrial uses, and non-conformance with these requirements results in rejection of the alloy. Any cold work that is performed on Incoloy® 909, for example, cold drawing of the wire, requires a re-solution and precipitation heat treatment. Re-solution annealing is one of the critical steps in controlling the grain size, and subsequent material properties of the alloy. It is recommended that the re-solution annealing be performed at about 982° C.±14° C. to avoid excessive grain growth. If this temperature exceeds the recommended limits, rapid grain growth occurs, resulting in a reduction in the strength of the alloy.

Rejection of alloys due to non-conformance of the grain size is unfortunately quite common. Re-working of the alloy is usually to be avoided, since an additional cold drawing step performed above a critical deformation level, often changes the final dimensions of the alloy bar. Additionally, alloys such as Incoloy® 909 and CTX-909 are custom fabricated by their individual manufacturers. The conventional process is lengthy, with a typical delivery cycle of bet ween six months and one year. Further, the end user must typically order a whole mill run, even when only a small quantity is desired. The lengthy manufacturing time and limited availability of the alloys create serious problems for the end users for several reasons. First, the user must anticipate his/her needs well in advance, yet may still fall short of the needed quantity of the alloy. Second, current processes do not allow the end user to rework a larger size alloy bar stock into a smaller size. Modification is generally performed by the alloy manufacturer. There, thus, remains a need to provide a more efficient process for producing high strength and thermally stable alloys of a desired size for use in high temperature applications.

SUMMARY OF THE INVENTION

The present invention is directed to a thermomechanical method for producing alloys with increased tensile strength and thermal stability. The method of the present invention further provides a means of fabricating smaller size alloy bars and rods with greater flexibility than those produced by conventional methods. The method involves heat treating and then rotoforging the alloy material at a sufficient deformation level and temperature to fragment the grain boundary phases of the alloy. Subsequent precipitation age-hardening results in an alloy having increased tensile strength at room and elevated temperatures (~649° C.), good ductility, and excellent stress-rupture characteristics. The thermomechanically treated alloy is characterized by a micro structure exhibiting an ultra-small grain size of about 7 microns or less in diameter, fragmentation of the grain boundary phases, and dispersed carbides inside the grains.

Rotoforging has not heretofore been applied or considered in the fabrication of small diameter alloy bars and rods, and provides a means of producing smaller size alloy materials from larger sized alloy material. This feature is particularly beneficial in overcoming the production problems that consumers typically face with existing manufacturing processes. With only two producers of Alloy 909, the consumer must typically order a whole mill run, even when the quantity desired is small. Further, the delivery cycle is quite lengthy (typically 6–12 months) and, as a result, the availability of the Alloy 909 is frequently limited. The thermomechanical method of the present invention overcomes these problems by providing a means for the consumer to forge alloy materials to a desired size and quantity. The present method can be used to produce new and improved alloys having comparable superior mechanical and thermal properties for use in high temperature applications including, but not limited to, jet engines, x-ray generating devices, gas turbine components such as combustion blades and vanes, etc.

DETAILED DESCRIPTION OF THE INVENTION

The present invention is directed to superalloys having superior mechanical properties and increased thermal stability at both room and elevated temperatures. Additionally, the present invention provides a novel thermomechanical process for producing the superalloys, which utilizes rotoforging to produce a resulting alloy material having an ultra-fine, very uniform grain size, high tensile strength at room and high temperatures (~649° C.), good ductility, and excellent stress-rupture characteristics.

Figure 5:
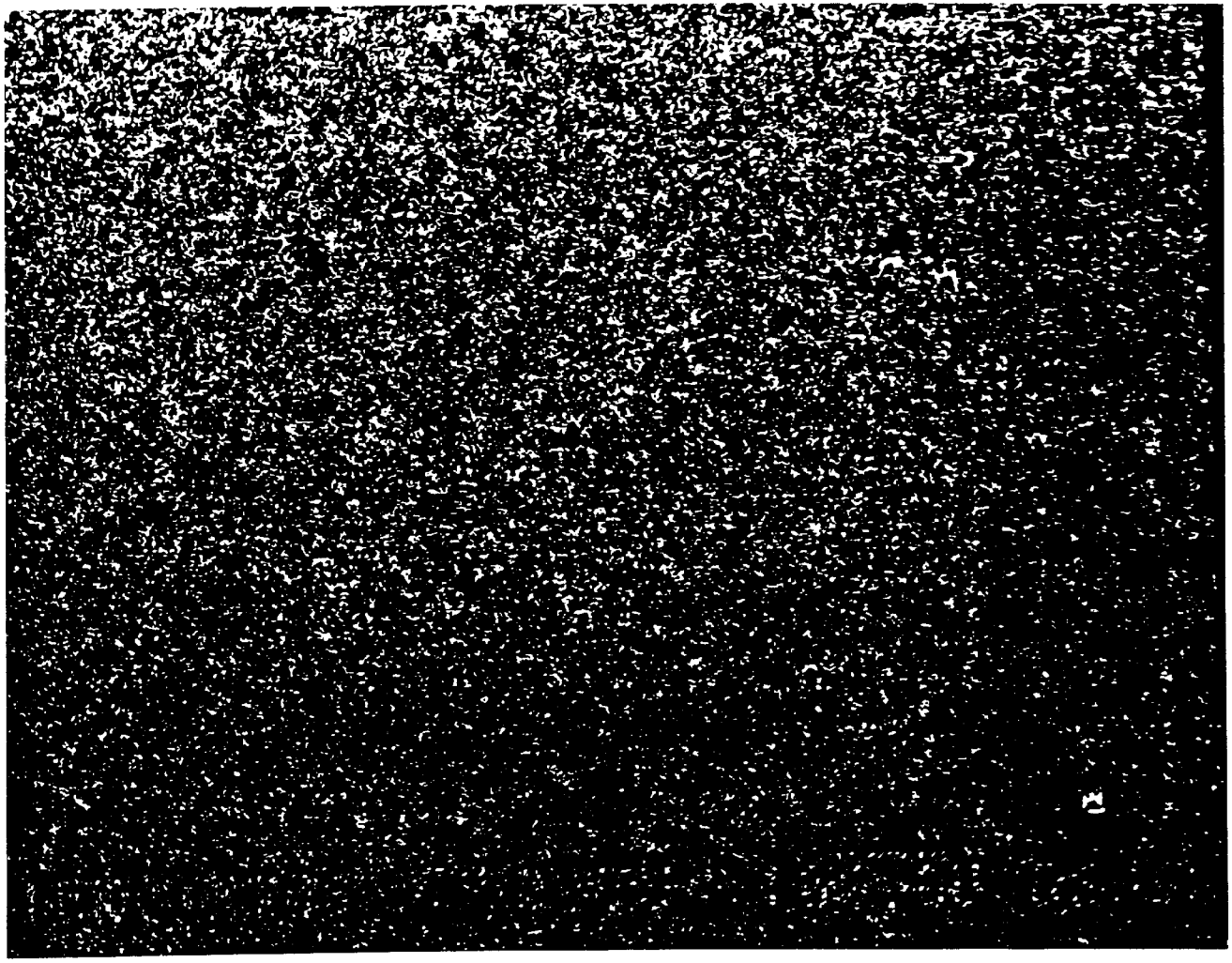
FIG. 5 is a SEM micrograph of the cross-sectional microstructure of CTX-909 after thermomechanical treatment. The average grain size in cross-section is 5.0 μm. The magnification is 165×: scale: 1.65 cm=100 μm.
Figure 6:
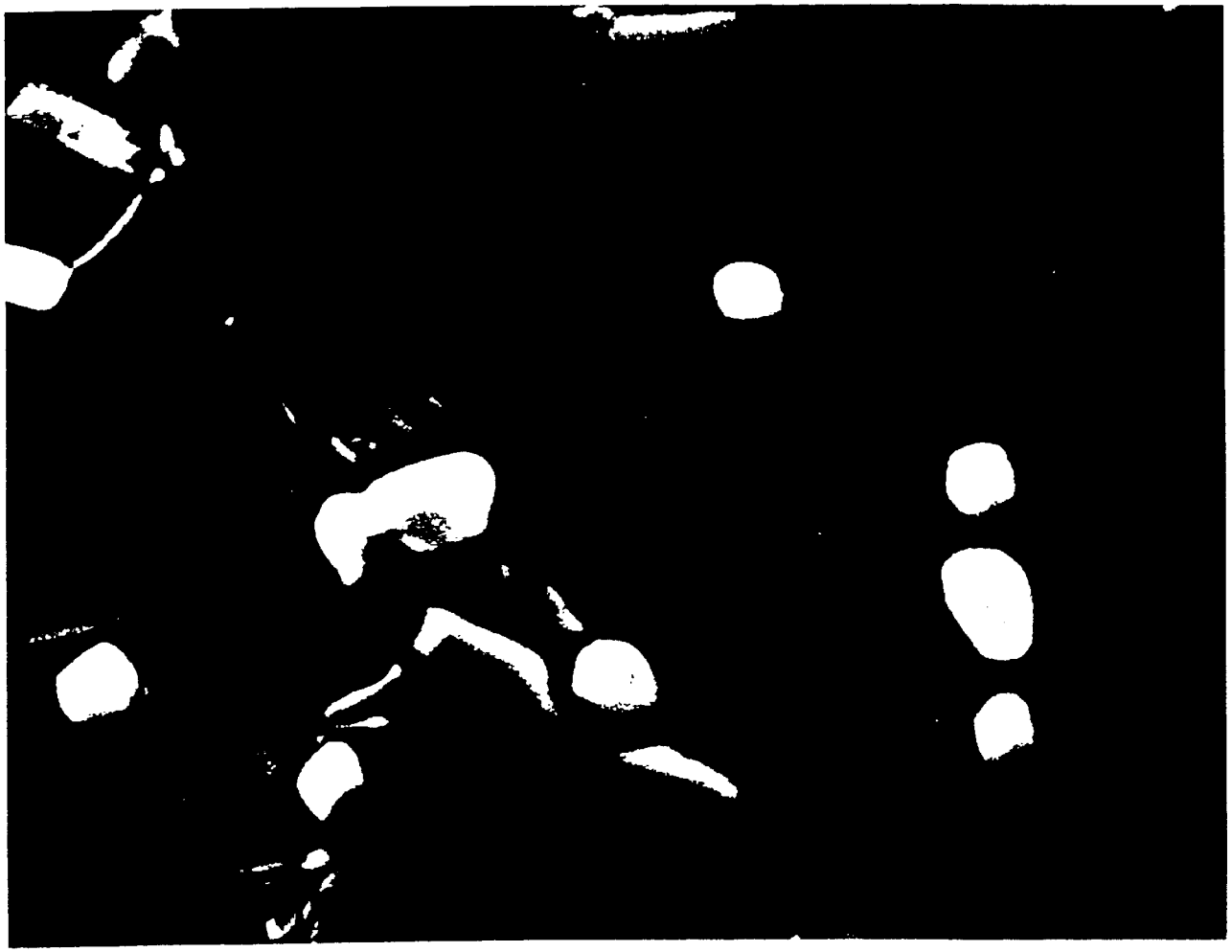
FIG. 6 is a SEM micrograph of the cross-sectional microstructure of CTX-909 after thermomechanical treatment, in particular, the fragmented niobium carbide particles. The average grain size is 5.0 μm. The magnification is 16,500×; scale: 1.65 cm=1.0 μm.
Figure 9:
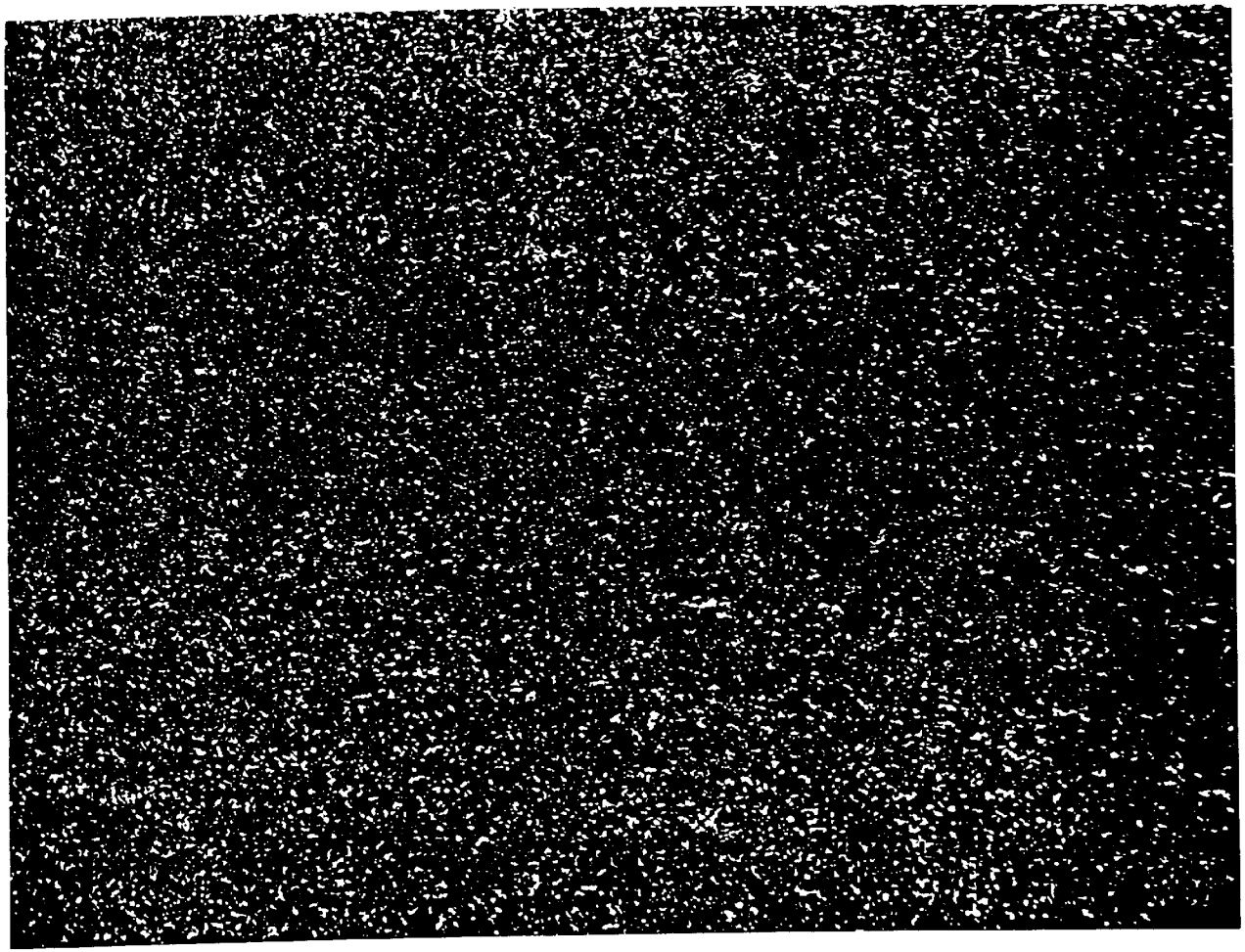
FIG. 9 is a SEM micrograph of the cross-sectional microstructure of Incoloy® 909 after thermomechanical treatment. The average grain size is 6.7 μm, which is considerably smaller than the grain size of the untreated Incoloy® 909 (compare with FIG. 7). The magnification is 165×: scale: 1.65 cm=100 μm.
Figure 10:
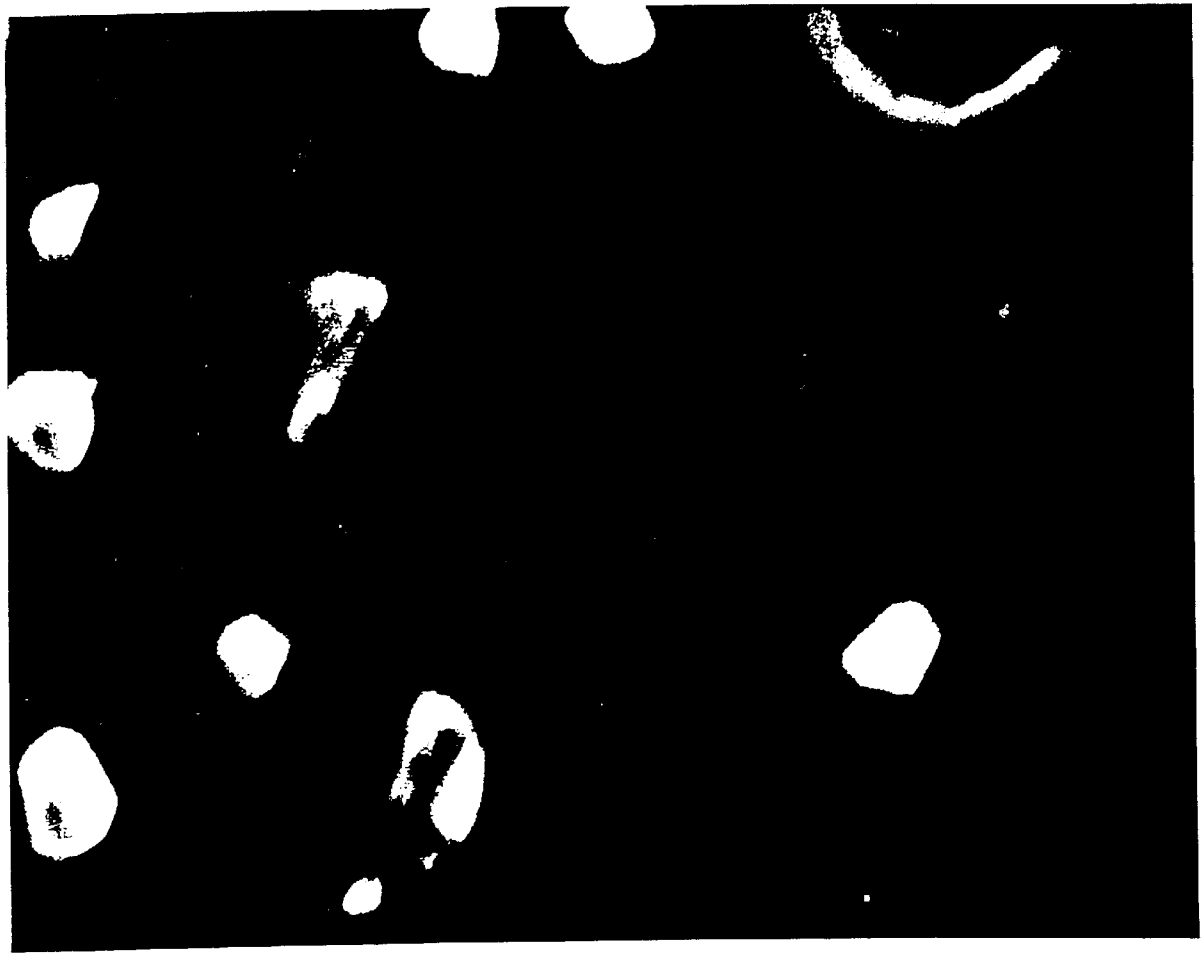
FIG. 10 is a SEM micrograph of the cross-sectional microstructure of Incoloy® 909 after thermomechanical treatment. The magnification is 16,500×: scale: 1.65 cm=1.0 μm. The average grain size is 6.7 μm.

The mechanical properties of the superalloys of the present invention are significantly improved over those of the prior art when superalloy material in the solution annealed condition is rotoforged, using a high area reduction schedule with intermediate anneals at temperatures below the dissolution of the Laves phases. The resulting superalloy exhibits an ultra-fine, very uniform grain size as illustrated in FIGS. 5 and 9. A summary of the mechanical and thermal properties of the superalloy produced by the process of the present invention is shown below in Table 1. In addition to the superior properties, the thermomechanically treated superalloy retains these properties across a broad temperature interval. Table 2 summarizes the properties of the rotoforged alloy obtained after different re-solution anneal schedules.

The thermomechanical process of the present invention has created additional benefits for the consumer. For example, rotoforging, a process not heretofore used in the fabrication of small diameter (alloy) bars and rods, allows the consumer to fabricate a pre-selected alloy material into a desired size and in the quantity needed. Until now, these benefits were unavailable with conventional processes such as hot rolling and wire drawing. Although the present invention is applicable to high temperature environments such as an x-ray generating device, it should be apparent to one skilled in the art that the present process may be utilized for other applications, where a combination of high strength at room temperature and good high temperature properties such as creep resistance and stress rupture are required. For example, jet engines, and gas turbine components, such as combustion blades and vanes, will benefit from such advanced alloy properties.

It should be further noted that Alloy 909 is used herein for discussion and demonstration purposes only. It should not be construed that the present invention is limited to this alloy. Rather, it is contemplated that the process of the present invention can be applied to other alloys to create other superalloys having superior mechanical and thermal properties comparable to that of each respective untreated alloy, thereby allowing various superalloys to be created for various high temperature applications.

Superalloys such as Incoloy® 909 and CTX-909 are very sensitive to thermomechanical treatments so that one of ordinary skill in the art would not be motivated to fabricate smaller diameter alloy bars and rods from larger size alloy bars. In an attempt to overcome the problems previously noted with conventional processes for producing superalloy bars, a superior superalloy was produced wherein the superalloy material in the solution annealed condition was rotoforged using a high area reduction schedule with intermediate anneals at temperatures below the dissolution of the Laves phases.

With the method of the present invention, a bar of alloy material of a defined size was heated to high temperatures (~980° C.) followed by rotation at high speeds. Examples of the forging method as used in the present invention are presented below. Starting material with a diameter 2.625 inches was processed as follows:

1. Preheated to 982° C. (range 950° C. to 1010° C.) and then reduced to 1.75 inches in 8 passes with an average of 3 mm (in diameter) per pass. This corresponds to an average of 9–12% deformation per pass.
2. Preheated to 982° C. (range 950° C. to 1010° C.) and then reduced to 1.5 inches in 3 passes with an average of 2 mm (in diameter) per pass. This corresponds to an average of 9–12% deformation per pass.
3. Preheated to 982° C. (range 950° C. to 1010° C.) and then reduced to 1.0 inch in 5 passes with an average of 2.5 mm (in diameter) per pass. This corresponds to an average of 14–17% deformation per pass.
4. Preheated to 982° (range 950° C. to 1010° C.) and then reduced to 0.5 inches in 5 passes with an average of 2 mm (in diameter) per pass. This corresponds to an average of 19–23% deformation per pass. The total process of reducing a 2.625 inch bar to a 0.5 inch diameter rod consisted of 4 cycles with 21 passes in total, at an average deformation per pass of 14%.

It should be noted that the temperature during forging should not be less than 760° C. in order to avoid cracking of the alloy. Deformation should be gradually increasing, when going to small diameter rods with an average deformation per pass from about 7% to about 25%. This is done to maintain the temperature at a sufficient level to avoid cracking.

While being rotated at high speed, the bar was simultaneously pounded on all sides with anvils or a similar instrument. With pounding, the size of the bar material became smaller and longer. If the resulting bar was the desired size after one cycle of rotoforging, then no further rotoforging was performed. However, if a smaller size alloy bar was desired, the bar/rod was re-heated and then passed through another cycle of rotoforging, with the steps of pre-heating and rotoforging being repeated until the desired alloy size was produced. For example, alloy material over two and a half inches in diameter was subject to rotoforging and resulted in a ½ inch diameter rod. It was further discovered that the properties of the new and reduced alloy material were superior to those of the original (larger size) material.

Properties of commercially manufactured standard material are shown below in Table 1. In accordance with AMS 5884 manufacturing guidelines, minimum requirements must be achieved, otherwise the material is deemed to be non-conforming and unacceptable at high temperatures. In this regard, the average grain size must be 5 or finer. The higher the grain size, the smaller the grain. Yield refers to yield strength at 0.2% deformation. This value must be a minimum of 140 ksi for the standard alloy material. Tensile strength must be a minimum of 175 ksi and elongation at least 8%. The combination stress rupture and elongation at 649° C., at 74 ksi is 23 hours. This is the minimum allowable stress rupture time with an elongation minimum of 4%. If these minimum properties are not achieved, the alloy material is scrapped.

Referring to the second column in Table 1, the properties are shown for the raw stock material CTX-909 that was used for rotoforging in the present invention. The raw stock material was originally 67 mm in diameter prior to undergoing the thermomechanical treatment. The properties of the raw material were determined by the manufacturer. The average grain size of the raw stock material provided was 45 microns. The yield was 154 ksi and the tensile strength at room temperature was determined to be 192 ksi. The combination stress rupture at 649° C., at 74 ksi was 104.3 hours, and the elongation was 26.7%.

TABLE 1

Summary of Mechanical Properties of Alloy 909 for different material lots

| Property | AMS 5884 minimum properties | C-203356* 67 mm dia. Hot rolled. (Raw Stock for rotoforging) | HW0651VY14** Hot Rolled + Wire Drawn to 7.7 mm + Cold drawn to 4.75 mm dia. | Rotoforged from 67 mm dia. (C-203356) to 14 mm dia. (~½ inch) |
|---|---|---|---|---|
| Avg. Grain Size (ASTM) | 5 or finer | 6 | 10 | 10+ |
| Avg. Dia. in Microns | 65 | 45 | 11 | 7 |
| Yield Strength (0.2)(ksi) | 140 | 154 | 154 | 187 |
| Tensile Strength (ksi) - room temperature | 175 | 192 | 184 | 215 |
| Elongation (%) | 8 | 15 | 17.4 | 12 |
| Reduction Area (%) | 12 | 30 | 39 | 33 |
| Yield @ 649° C. (ksi) | 105 | 130.5 | | 145.5 |
| Tensile @ 649° C. (%) | 135 | 149.5 | | 169.5 |
| Elongation @ 649° C. | 10 | 26 | | 19 |
| Reduction @ 649° C. (%) | 15 | 61 | | 48 |
| Combin. Stress Rupture @ 649° C., 74 ksi Elongation (%), hrs | 4% 23 h | 26.7% 104.3 h | | 16.5% 72.2 hrs |
| Stress Rupture of bolts @ 1010 lbs, 649° C. | | | 87.45 hrs to failure | 214.3 hrs, no failure |

Note:
*indicates Carpenter Technology material CTX-909
**indicates Inco material Incoloy ® 909

In accordance with the process of the present invention, superalloy Batch No. C-203356 was rotoforged to a 14 mm diameter (~½ inch). Stress rupture is determined by subjecting the alloy material to a constant stress, in this instant case 74 ksi, at a temperature of 649° C. The alloy material is then tested until it fails. The time of failure is noted as the rupture time for the alloy material.

When evaluating the rotoforged alloy material that is achieved in accordance with the process of the present invention, the grain size (~7 microns) was found to be considerably smaller than the grain size of the untreated alloy material. The yield increased from 154 ksi to 187 ksi. This is over a 20% increase in the yield strength of the rotoforged material. Further, the tensile strength at room temperature also increased from 192 ksi to 215 ksi. The tensile strength at high temperatures (649° C.) is also a very important parameter. The minimum AMS 5884 guidelines require a minimum of 135 ksi. The untreated starting alloy material used in the present process had a tensile strength of 149.5 ksi. After rotoforging, the improved alloy material had a tensile strength of 169.5 ksi, indicating a 20 ksi improvement.

The rotoforged material was used for fabricating fasteners used in x-ray tube application. The stress rupture test conducted on the bolts made from rotoforged alloy (shown in Table 2, column 5) was interrupted after 214.3 hours, prior to failure of the bolt. These results are far superior to the stress-rupture time to failure of 87.5 hrs (shown in Table 1, column 4) for bolts made of a conventional material, which was fabricated by hot rolling, followed by hot wire drawing to 7.7 mm and finished by cold drawing to 4.75 mm rod.

When viewing the summary of the mechanical and thermal properties of the tested alloys, it should be apparent to those skilled in the art that the treated (rotoforged) alloy material exhibits ultra-fine, very uniform grain size, high tensile strength at both room and elevated temperatures, good ductility, and excellent stress-rupture characteristics. These results are achieved by unconventional thermomechanical processing not heretofore used in fabricating smaller size alloy bars and rods.

Although the composition of Incoloy® 909 and CTX-909 (as shown below in Table 3) remains substantially the same throughout the present process, the microstructural characteristics of each alloy undergoes significant changes in response to the thermomechanical treatment process. This is shown in FIGS. 1 through 11.

TABLE 3

| Chemical Composition of Incoloy ® 909, % | |
|---|---|
| Ni | 38.0 |
| Cr | — |
| Co | 13.0 |
| C | .01 |
| Fe | 42 |
| Ti | 1.5 |
| Al | .03 |
| Mo | — |
| Others | 4.7 |
| Silicon | 0.4 |
| **Chemical Composition of CTX-909, %** | |
| Ni | 38.0 |
| Cr (maximum) | 0.5 |
| Co | 14.0 |
| C (maximum) | 0.06 |
| Fe | Balance |
| Ti | 1.6 |
| Al (maximum) | .15 |
| P | 0.015 |
| B | 0.012 |
| Silicon | 0.4 |
| Mg (maximum) | 0.5 |
| Sulfur (maximum) | 0.015 |
| Columbium + Tantalum | 4.9 |
| Copper (maximum) | 0.5 |

Figure 1:
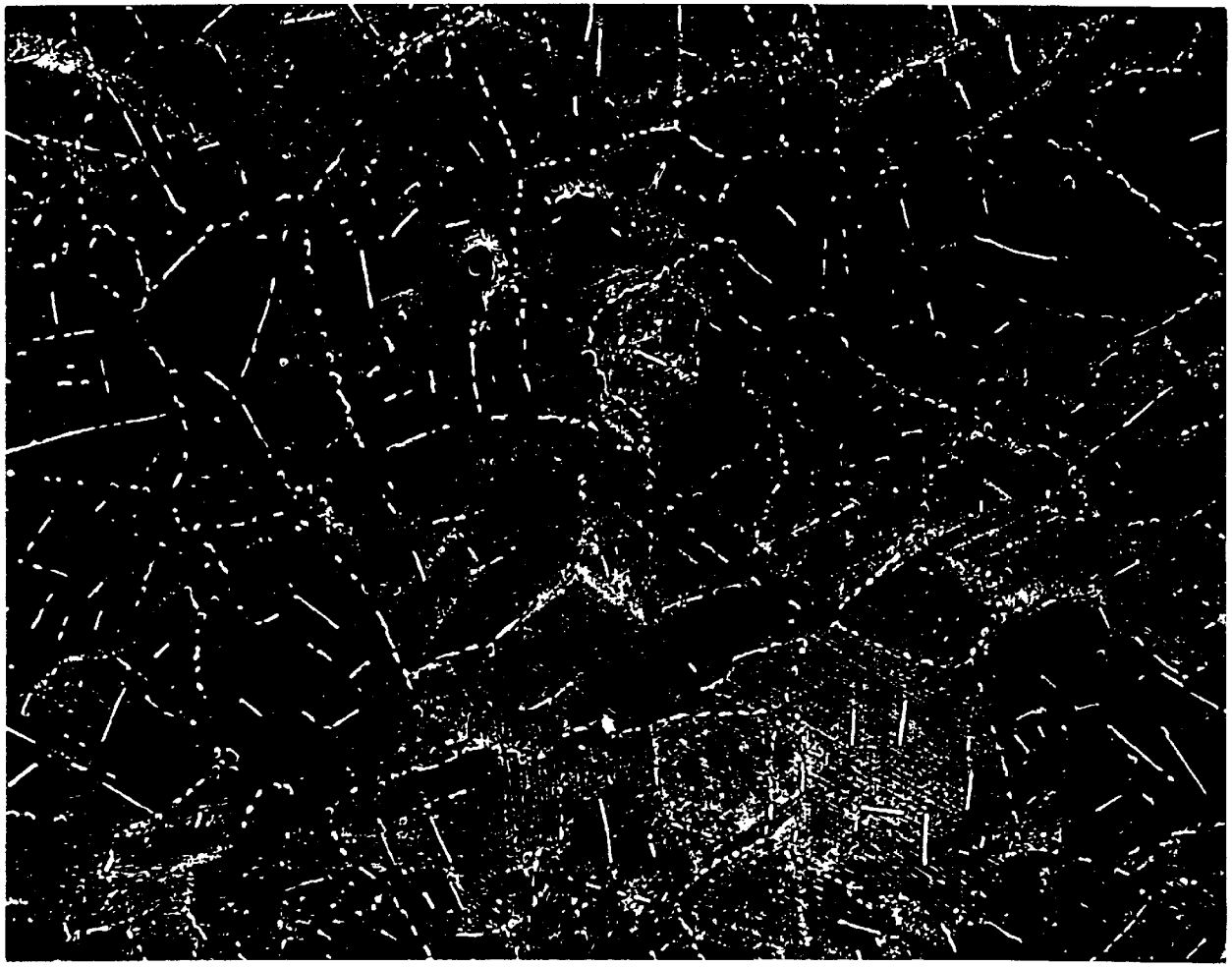
FIG. 1 is a SEM micrograph of the microstructure of CTX-909, a commercially-available, low thermal expansion alloy, as received from Carpenter Alloys (untreated) (prior art). The term, "untreated," as used throughout the specification refers to alloy material that has not been subjected to the thermomechanical treatment of the present invention. The average grain size is 15.4 μm and 31.6 μm in longitudinal section. Intergranular precipitation is seen along the grain boundaries. The magnification is 1650×: scale: 1.65 cm=10 μm.
Figure 2:
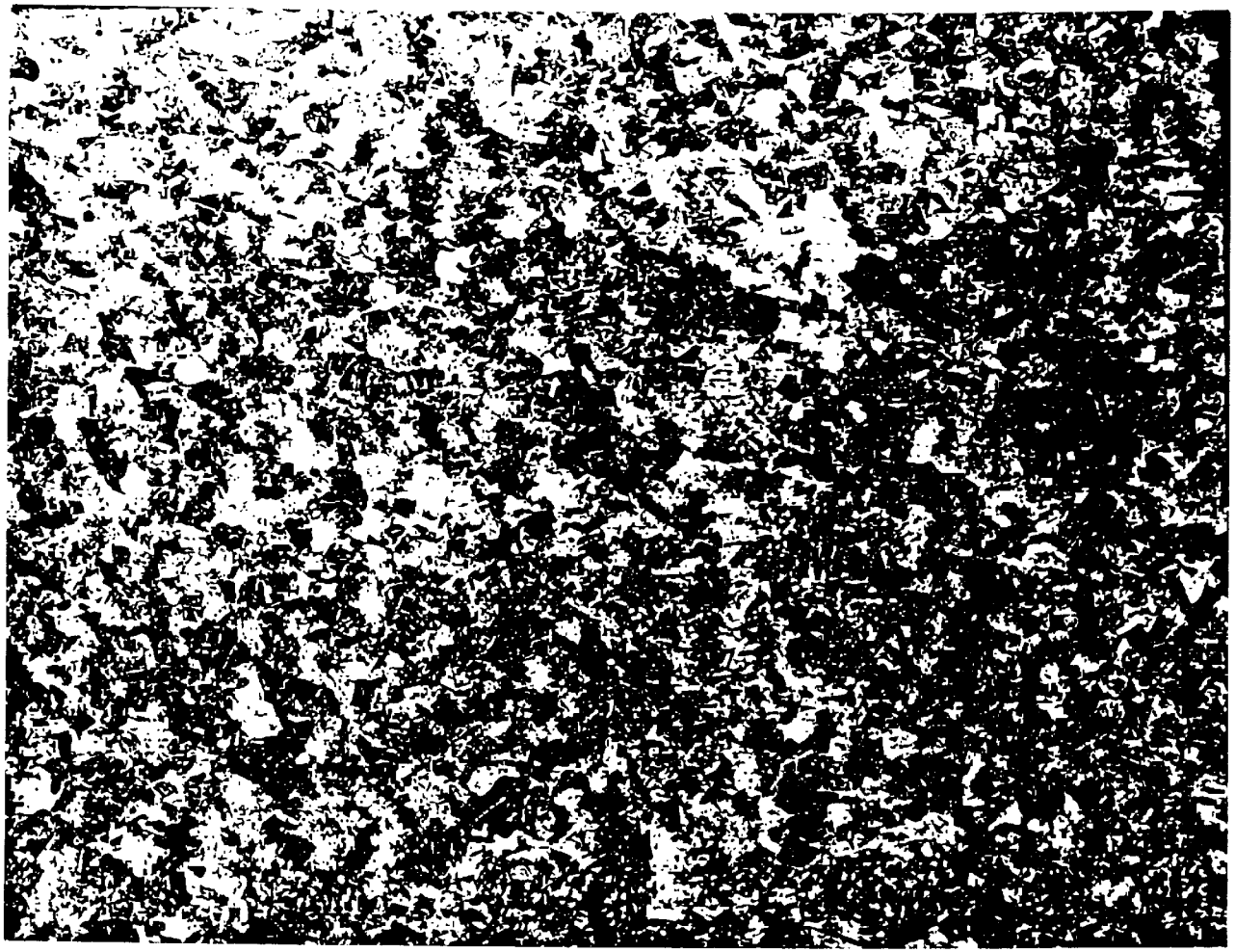
FIG. 2 is a SEM micrograph of the cross-sectional microstructure of untreated CTX-909 at magnification of 165× (prior art). The average grain size is 15.4 μm in cross-section, scale: 1.65 cm=100 μm.
Figure 3:
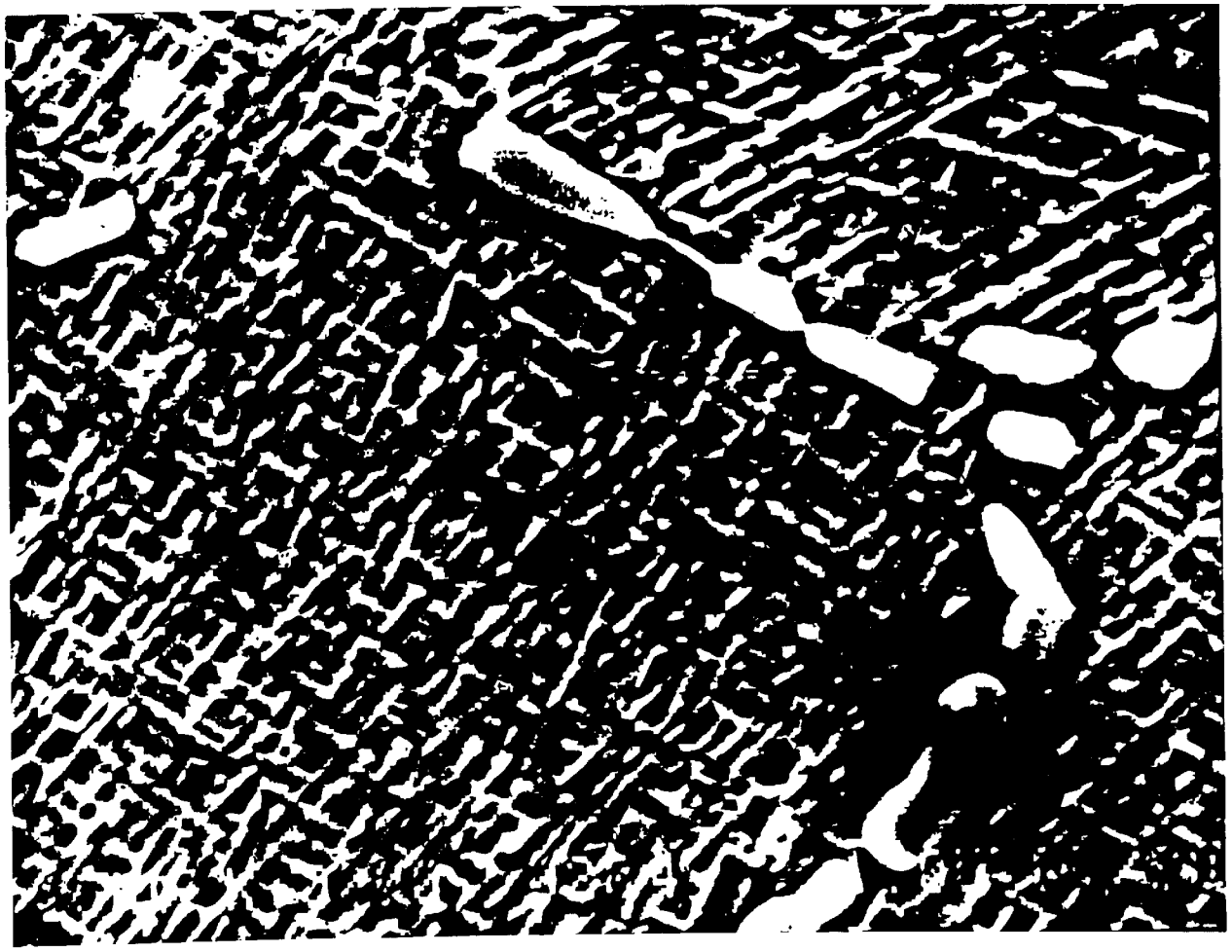
FIG. 3 is a SEM micrograph of the cross-sectional microstructure of untreated CTX-909, in particular, the niobium carbide lenticular phase along the grain boundaries (seen as large elongated particles) (prior art). The magnification is 16,500×: The average grain size in cross-section is 15.4 μm; scale: 1 cm=1.65 μm.
Figure 4:
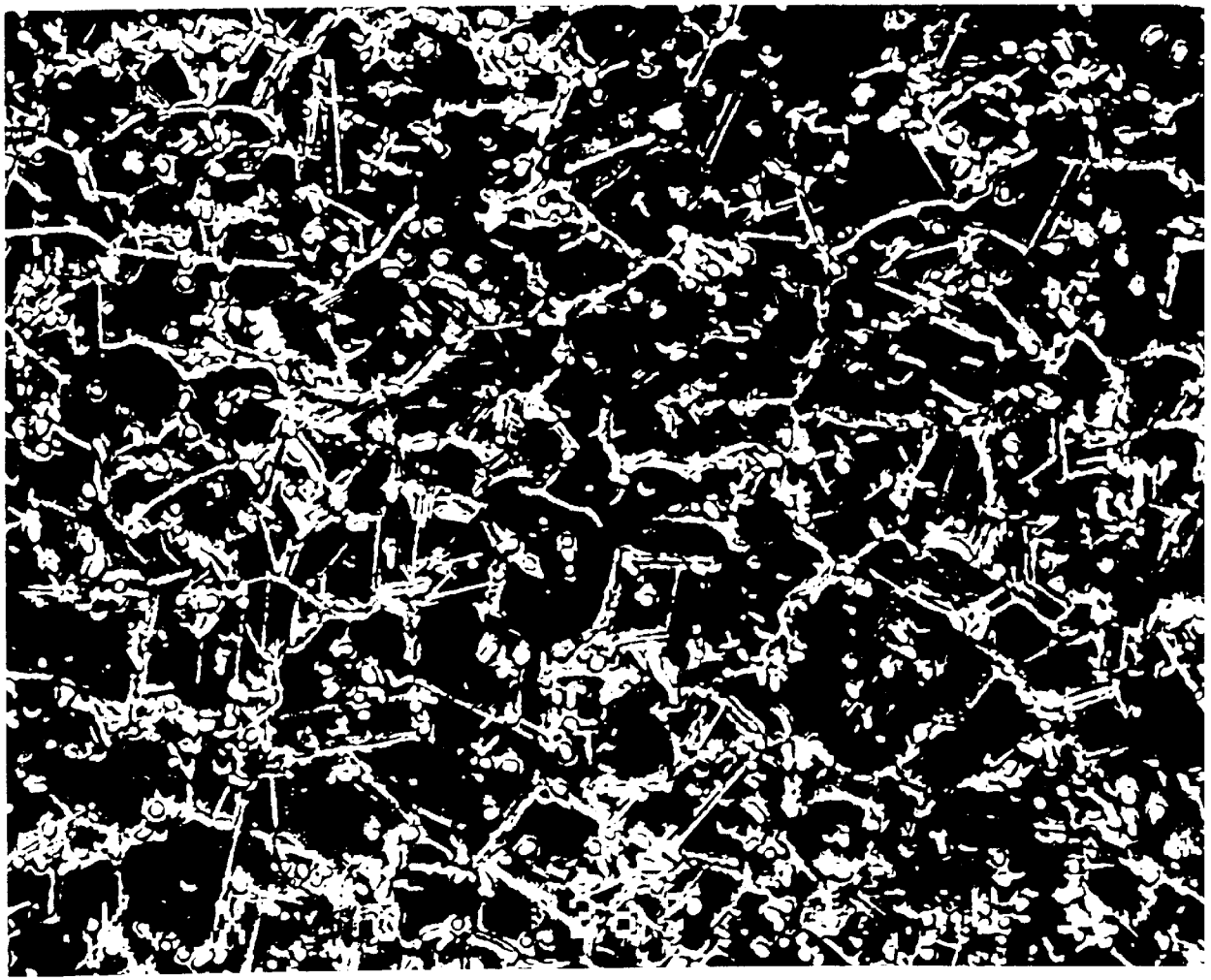
FIG. 4 is a SEM micrograph of the microstructure of CTX-909 that has been subjected to the novel thermomechanical treatment of the present invention. The average grain size in cross-section is 5.0 μm, and 9.0 μm in longitudinal section which is considerably smaller than the grain size of the untreated CTX-909 compare with FIG. 1). Intragranular precipitation is seen inside the grains. The magnification is 1650×; scale: 1.65 cm=10 μm.

FIG. 1 is a SEM micrograph of the microstructure of untreated CTX-909. The intergranular precipitation is visible along the grain boundaries. The precipitates provide one type of strengthening mechanism for the alloy, as well as, phase stability. In FIG. 1., the carbides can be seen as the long, thin white lines. Similarly, FIG. 7 illustrates the existence of intergranular precipitates along the grain boundaries in the microstructure of untreated Incoloy® 909.

Figure 7:
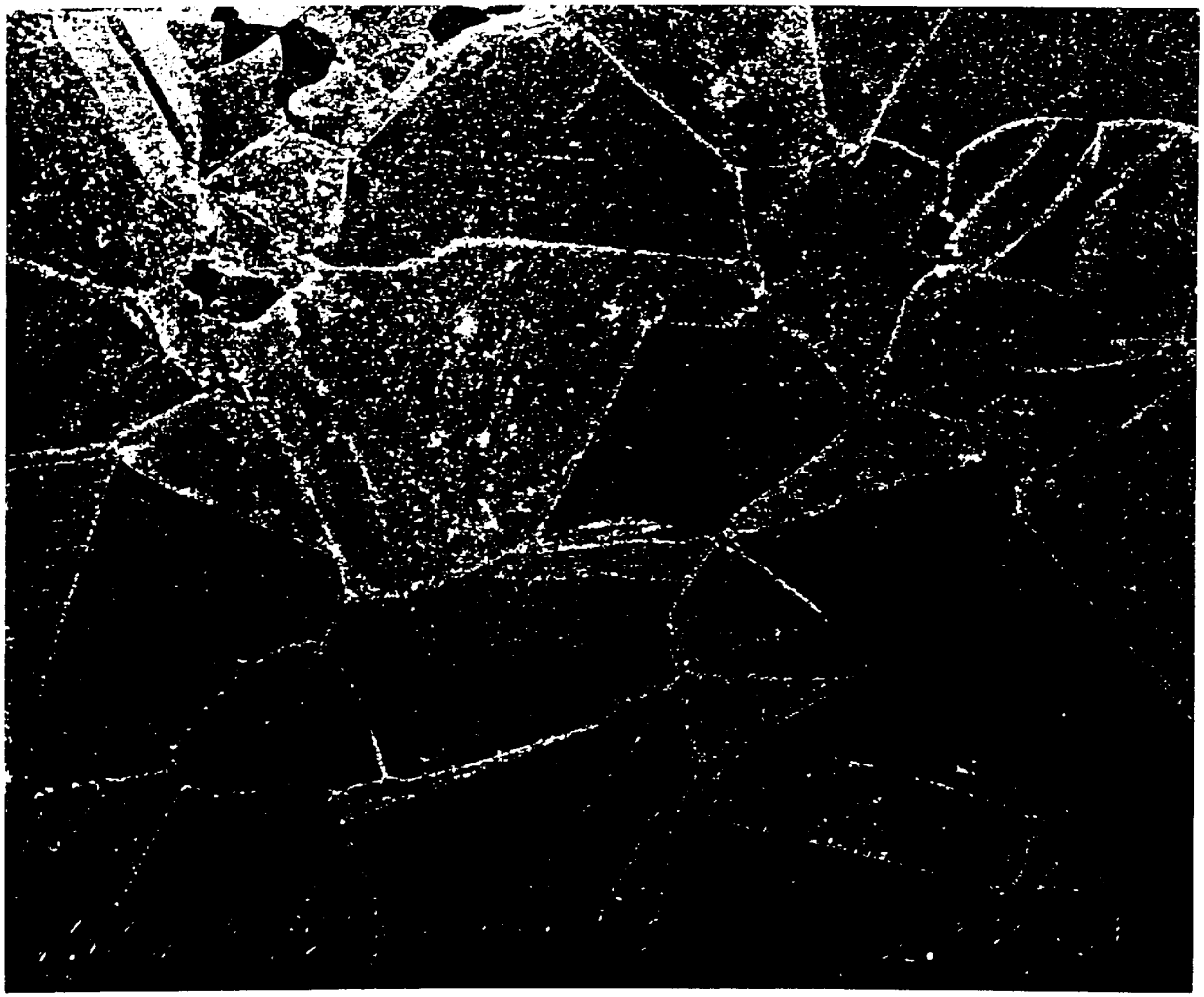
FIG. 7 is a SEM micrograph of the cross-sectional microstructure of Incoloy® 909 as received from Inco International (untreated) (prior art). The average grain size is 179 μm. The magnification is 165×: scale: 1.65 cm=100 μm.
Figure 8:
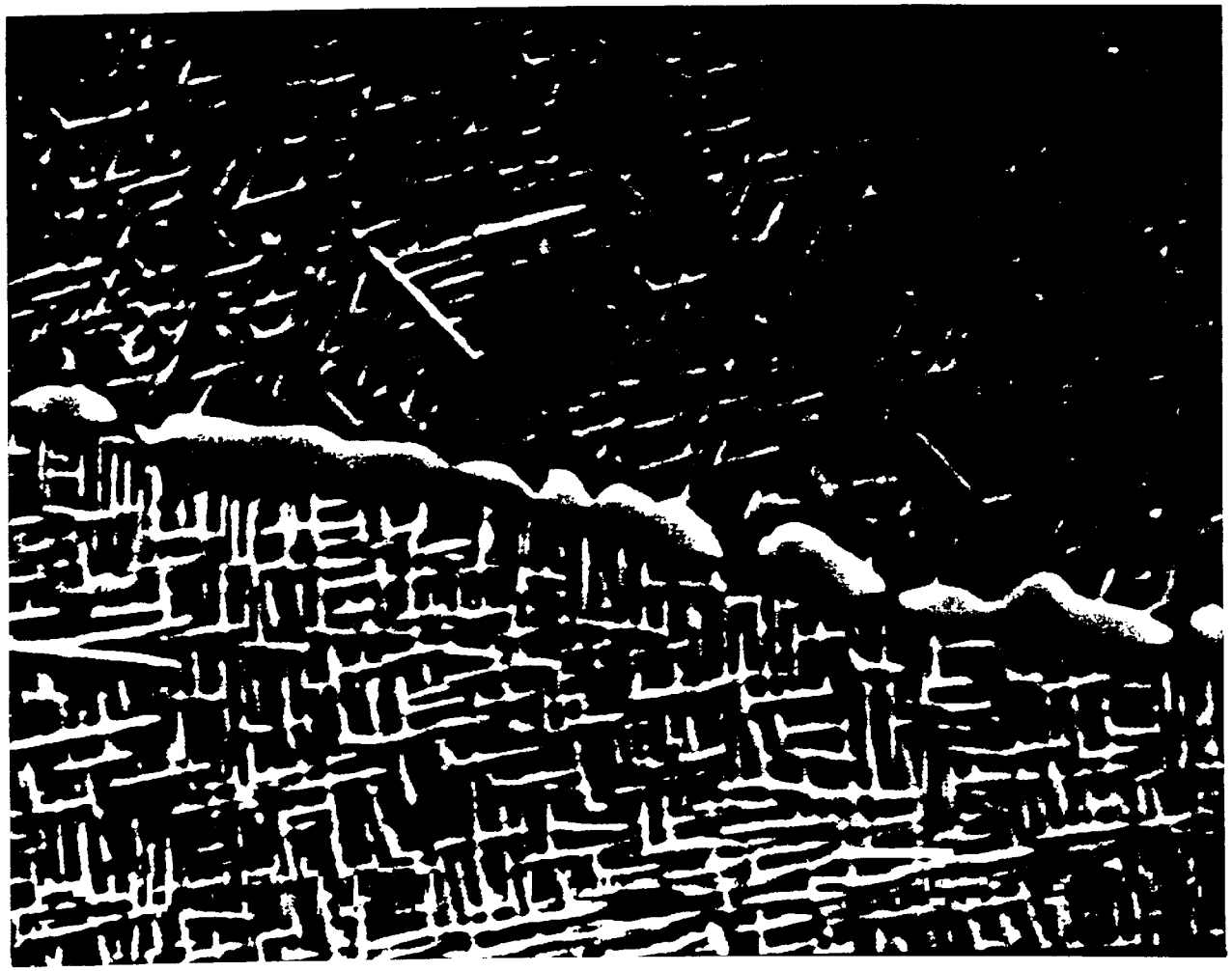
FIG. 8 is a SEM micrograph of the cross-sectional microstructure of Incoloy® 909 as received from Inco International (untreated) (prior art). The average grain size is 179 μm. The magnification is 16,500×: scale: 1.65 cm=1.0 μm.

Contrast FIGS. 1 and 7 with FIGS. 4, 5, 6, 9, 10 and 11, which illustrate the microstructural characteristics of treated (rotoforged) alloy material. It should be noted that the treated material exhibits ultra-fine, very uniform grain sizes, and the precipitates (or particles) are located inside the grains (intragranular precipitation). The location of the precipitates inside the grains is quite important for the stabilization of the alloy's microstructure. Intragranular precipitation further prevents the grains and grain boundaries from shifting and deforming, resulting in greater tensile strength for the alloy.

In carrying out the thermomechanical treatment of the alloys, using rotoforging at high area reduction schedule with intermediate anneals at temperatures below the dissolution of these phases, which are carbides (NbC), nitrides (TiN), and Laves phases, these grain-boundary-lining phases are becoming fragmented and then dispersed inside the grains. They pin the grain boundaries and the dislocations inside the grains, thereby contributing to the grain size refinement, as well as providing a strengthening mechanism. This mechanism is called dispersoid strengthening.

The properties of the rotoforged alloy obtained after different re-solution anneal schedules are summarized below in Table 2. Results demonstrate that after thermomechanical treatment, the alloy retained its superior mechanical and thermal properties over a wide temperature interval.

TABLE 2

Tensile and Stress Rupture Properties of Alloy 909 Alloy Bar Processed from Rotoforged Billet

| Re-Solution Heat Treatment* | Room Temp. Tensile Properties (ksi, %) | Tensile Properties @ 649° C. (ksi, %) | 649° C. Stress Rupture Properties @ 74 ksi (hrs, %) Time (hrs) | EL (%) |
|---|---|---|---|---|
| 982° C. - 1 hour | YS: 181 ksi<br>TS: 215 ksi<br>EL: 13.5%<br>RA: 38% | YS: 146 ksi<br>TS: 170 ksi<br>EL: 19%<br>RA: 48% | 722 | 165 |
| 1010° C. - 1 hour & 982° C. - 1 hour | YS: 184 ksi<br>TS: 216 ksi<br>EL: 13%<br>RA: 40% | YS: 143 ksi<br>TS: 167 ksi<br>EL: 16.5%<br>RA: 34.5% | 73.9 | 13 |
| 1038° C. - 1 hour & 982° C. - 1 hour | YS: 195 ksi<br>TS: 222 ksi<br>EL: 11%<br>RA: 22.5% | YS: 147 ksi<br>TS: 167 ksi<br>EL: 11.5%<br>RA: 22% | 78.8 | 7.5 |
| AMS 5884** Requirements @ 74 ksi (Minimum) | YS: 140 ksi<br>TS: 175 ksi<br>EL: 8%<br>RA: 12% | YS: 105 ksi<br>TS: 135 ksi<br>EL: 10%<br>RA: 15% | 23 | 4 |

*The properties tested after standard precipitation heat treatment at 718° C. for 8 hours, followed by 621° C. for 8 hours per AMS 5884
**Benchmark data show minimal required properties per AMS 5884

In summary, the superior mechanical and thermal properties exhibited by the alloys of the present invention are as follows:

1) Ultra fine grain size of about 7 microns or less in average diameter;
2) Tensile strength at room temperature 215±10 ksi;
3) Tensile strength at high temperatures 170±10 ksi;
4) Combination of room temperature and high temperature tensile strength and stress rupture rate are significant properties for the alloy; and
5) Combination of high strength and high elongation (12%±2).

Figure 11:
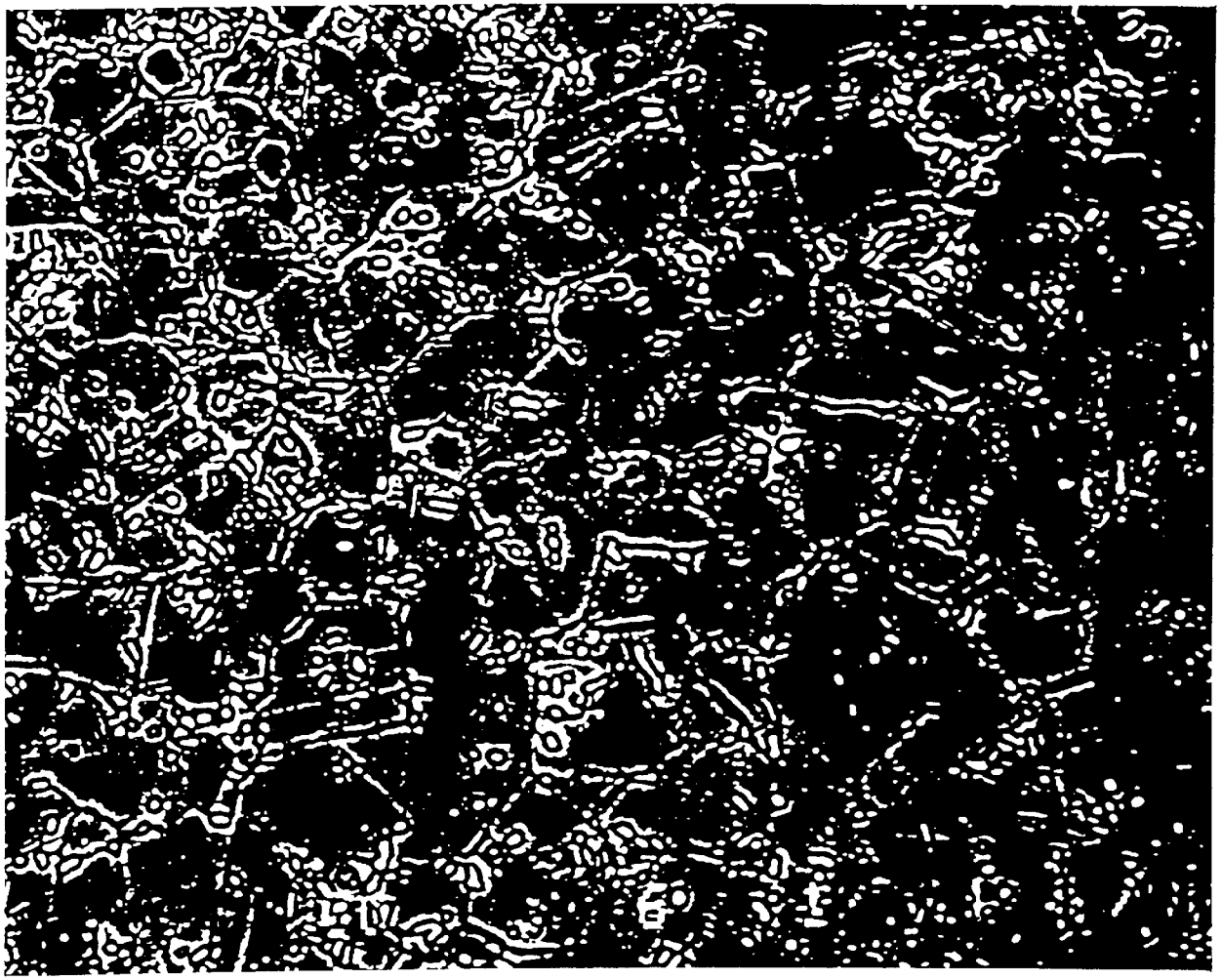
FIG. 11 is a SEM micrograph of the cross-sectional microstructure of a bolt shank in transverse section fabricated from a rotoforged material. This bolt was stress-rupture tested at 649° C., at 74 ksi for 214.3 hours and removed prior to failure.

The observed improvement in properties is attributed to two mechanisms:

1) Ultra-fine an very uniform (across the transverse section) grain, which is achieved by forging at high energy and temperatures below dissolution of Laves phases, therefore inhibiting in-situ grain growth, while maintaining uniform stress. A comparison between the initial grain size prior to and after the rotoforging is shown in Table 1.
2) The Laves phases originally present in the original Alloy 909, as the "grain-boundary lining" phases, are fragmented during the rotoforging process. The fragmentation contributes to a dispersoid-strengthening of the modified alloy. The microstructures are best illustrated in FIG. 11.

Although the invention has been described with reference to these preferred embodiments, other embodiments can achieve the same results. Variations and modifications of the present invention will be apparent to one skilled in the art and the following claims are intended to cover all such modifications and equivalents.

What is claimed is:

1. A high strength, thermally stable Ni—Fe—Co alloy at room and elevated temperatures, the alloy being characterized as a pre-manufactured alloy bar or rod stock with a nominal composition consisting essentially by weight of 38% Ni, 42% Fe, 13% Co, 4.7% Nb, 1.5% Ti, 0.4% Si, 0.03% Al, 0.01% C and absent Cr, that has been treated thermomechanically with heat and rotoforging, and having an ultra-small grain size, a dispersoid strengthening mechanism related to the fragmentation of the grain boundary carbide phases of the alloy and a stress rupture rate that is about twice as long as the untreated alloy bar or rod stock.

2. The alloy in accordance with claim 1, wherein the grain size is about 7 microns or less in diameter.

3. A high strength and thermally stable Ni—Fe—Co alloy at room and elevated temperatures, the alloy being characterized as a pre-manufactured alloy bar or rod stock with a nominal composition consisting essentially by weight of 38% Ni, 42% Fe, 13% Co, 4.7% Nb, 1.5% Ti, 0.4% Si, 0.03% Al, 0.01% C and absent Cr, that has been treated thermomechanically with heat and rotoforging, and having an ultra small grain size, intragranular precipitation with dispersed carbides inside the grains, and tensile strength about 20% greater than and a stress rupture rate that is about twice as long as the untreated alloy bar or rod stock.

4. The alloy in accordance with claim 3, wherein the grain size is about 7 microns or less in diameter.

5. The alloy in accordance with claim 3, wherein the tensile strength at room temperature ranges between approximately 205 ksi and 225 ksi.

6. The alloy in accordance with claim 3, wherein the tensile strength at elevated temperatures ranges between approximately 160 ksi and 180 ksi.

7. The alloy in accordance with claim 3, wherein the stress rupture rate is at least 2 to 3 times higher than the rate of the untreated alloy bar or rod stock.

8. A Ni—Fe—Co alloy having increased strength and thermal stability, the alloy being characterized as a pre-manufactured alloy bar or rod stock with a nominal composition consisting essentially by weight of 38% Ni, 42% Fe, 13% Co, 4.7% Nb, 1.5% Ti, 0.4% Si, 0.03% Al, 0.01% C and absent Cr, that has been treated thermomechanically with heat and rotoforging, and having a microstructure characterized by an ultra-small grain size of about 7 microns or less in diameter, and fragmentation of the grain boundary carbide phases.

9. A pre-manufactured Ni—Fe—Co alloy bar or rod stock with a nominal composition consisting essentially by weight of 38% Ni, 42% Fe, 13% Co, 4.7% Nb, 1.5% Ti, 0.4% Si, 0.03% Al, 0.01% C and absent Cr, that has been treated thermomechanically with heat and rotoforging and having the microstructural characteristics shown in FIG. 4, which include an average grain size in cross-section of 5.0 $\mu$m, and 9.0 $\mu$m in longitudinal section and intragranular precipitation inside the grains.

10. An x-ray generating device component, comprising a pre-manufactured Ni—Fe—Co alloy bar or rod stock with a nominal composition consisting essentially by weight of 38% Ni, 42% Fe, 13% Co, 4.7% Nb, 1.5% Ti, 0.4% Si, 0.03% Al, 0.01% C and absent Cr, that has been treated thermomechanically with heat and rotoforging, and having an ultra small grain size, intragranular precipitation with dispersed carbides inside the grains, and a tensile strength about 20% greater than and a stress rupture rate that is about twice as long as the untreated alloy bar or rod stock.

11. The x-ray generating device component in accordance with claim 10, wherein the grain size is about 7 microns or less in diameter.

12. The x-ray generating device component in accordance with claim 10, wherein the tensile strength at room temperature ranges between approximately 205 ksi and 225 ksi.

13. The x-ray generating device component in accordance with claim 10, wherein the tensile strength at elevated temperatures ranges between approximately 160 ksi and 180 ksi.

14. The x-ray generating device component in accordance with claim 10, wherein the stress rupture rate is at least 2 to 3 times higher than the rate of the untreated alloy bar or rod stock.

15. A thermomechanical process for increasing the strength and thermal stability of alloys, comprising the steps of:

a. pre-heating a pre-manufactured Ni—Fe—Co alloy bar or rod stock of a pre-selected size with a nominal composition consisting essentially by weight of 38% Ni, 42% Fe, 13% Co, 4.7% Nb, 1.5% Ti, 0.4% Si, 0.03% Al, 0.01% C and absent Cr, at a temperature below that at which grain growth occurs; and thereafter
b. rotoforging the heated alloy bar or rod stock at a sufficient deformation level and temperature to fragment the grain boundary carbide phases of the alloy.

16. The thermomechanical process in accordance with claim 15, further including the steps of repeating steps (a) and (b) until the desired size of the alloy or rod is produced.

17. The thermomechanical process in accordance with claim 15, wherein the rotoforging step is performed by gradually increasing deformation levels per pass ranging from about 7 to about 25% per pass.

18. The thermomechanical process in accordance with claim 15, wherein the rotoforging step is performed at temperatures not less than 760° C.

19. A high strength, thermally stable alloy produced by the process of claim 15, wherein the alloy is characterized by an ultra-small grain size, a dispersoid strengthening mechanism and a stress rupture rate that is about twice as long as the untreated alloy bar or rod stock.

* * * * *